US010887965B1

(12) United States Patent
Chen et al.

(10) Patent No.: US 10,887,965 B1
(45) Date of Patent: Jan. 5, 2021

(54) DOUBLE COLOR TEMPERATURE LAMP

(71) Applicant: SHENZHEN GUANKE TECHNOLOGIES CO., LTD, Shenzhen (CN)

(72) Inventors: Shoubao Chen, Shenzhen (CN); Qing Lan, Shenzhen (CN); Mingxiang Zou, Shenzhen (CN); Ligen Liu, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/718,423

(22) Filed: Dec. 18, 2019

(30) Foreign Application Priority Data

Oct. 24, 2019 (CN) ..... 2019 1 1021899

(51) Int. Cl.

| | |
|---|---|
| ***H05B 45/00*** | (2020.01) |
| ***H05B 45/40*** | (2020.01) |
| ***F21K 9/238*** | (2016.01) |
| ***F21V 29/70*** | (2015.01) |
| ***F21V 23/06*** | (2006.01) |
| ***H05B 45/10*** | (2020.01) |
| ***H05B 45/20*** | (2020.01) |
| ***F21V 23/00*** | (2015.01) |
| *F21Y 115/10* | (2016.01) |

(52) U.S. Cl.
CPC ..... *H05B 45/40* (2020.01); *F21K 9/238* (2016.08); *F21V 23/003* (2013.01); *F21V 23/06* (2013.01); *F21V 29/70* (2015.01); *H05B 45/10* (2020.01); *H05B 45/20* (2020.01); *F21Y 2115/10* (2016.08)

(58) Field of Classification Search
CPC ..... H05B 33/0815; H05B 33/0827; H05B 33/0845; H05B 33/0857; H05B 45/10; H05B 45/20; H05B 45/30; H05B 45/3725; H05B 45/37; H05B 45/42; H05B 45/52; H05B 45/54
USPC ..... 315/192, 294
See application file for complete search history.

(56) References Cited

U.S. PATENT DOCUMENTS

| | | | | |
|---|---|---|---|---|
| 2012/0056557 | A1* | 3/2012 | Li | H05B 45/10 315/294 |
| 2016/0255683 | A1* | 9/2016 | Wu | H05B 45/46 315/192 |
| 2018/0249547 | A1* | 8/2018 | Wang | H05B 45/46 |
| 2019/0082505 | A1* | 3/2019 | Delos Ayllon | H05B 45/48 |
| 2019/0327805 | A1* | 10/2019 | Ren | H05B 45/50 |
| 2019/0342962 | A1* | 11/2019 | Chang | H05B 47/19 |

(Continued)

*Primary Examiner* — Tung X Le
(74) *Attorney, Agent, or Firm* — Maier & Maier, PLLC

(57) ABSTRACT

A kind of double color temperature lamp, which includes: a base that includes the power access terminal of electrical connection, the driving power supply and the circuit switch. The circuit switch has multiple levels; a luminous module that comprises the high color temperature lamp bead module and the low color temperature lamp bead module. The high color temperature lamp bead module and the low color temperature lamp bead module are respectively electrically connected to multiple levels of the circuit switch. The double color temperature lamp of the present invention adjusts the high color temperature lamp bead module and the low color temperature lamp bead module through the circuit switch, and simplifies the circuit structure of the double color temperature lamp.

18 Claims, 6 Drawing Sheets

(56) References Cited

U.S. PATENT DOCUMENTS

2020/0120770 A1* 4/2020 Huang ..... F21S 4/10
2020/0260547 A1* 8/2020 Bruckner ..... H05B 45/37

* cited by examiner

DOUBLE COLOR TEMPERATURE LAMP

CROSS-REFERENCE TO RELATED APPLICATIONS

This application claims the priority of Chinese Patent Application No. 201911021899.4 filed on Oct. 24, 2019, the disclosure of which is incorporated herein by reference.

FIELD

The present invention relates to the field of lighting equipment, in particular to a double color temperature lamp.

BACKGROUND

The color temperature adjustment of LED lamps is to achieve different color temperatures by mixing the high color temperature lamp bead and the low color temperature lamp bead at different proportions. Generally, the dimming power is used to control the working state of high color temperature lamp bead and low color temperature lamp bead under different currents to obtain the mixing light of different color temperatures; that is to say, it can control the working power of the lamps; or it can control the output current of the lamps to obtain the mixing light of different color temperatures. In this way, it is necessary to adopt a lamp with variable power, that is, the lamp needs to adopt a complicated dimming system, so that the production cost of the lamp is high, and the manufacturing process is complicated.

The foregoing content is only used for assisting in understanding the technical scheme of the invention, but not mean the acknowledgement of that the above content is a prior art.

SUMMARY

The present invention aims at providing a double color temperature lamp to reduce the production cost of the lamp, simplify the manufacturing process of the lamp and improve the production efficiency of the lamp.

In order to achieve the above purpose, the double color temperature lamp provided by the present invention comprises:

A base that comprises the power access terminal of electrical connection, the driving power supply and the circuit switch. The circuit switch has multiple levels; and A luminous module that comprises the high color temperature lamp bead module and the low color temperature lamp bead module. The high color temperature lamp bead module and the low color temperature lamp bead module are respectively electrically connected to multiple levels of the circuit switch;

Adjust the level of the circuit switch to connect the driving power supply to the high color temperature lamp bead module and/or the low color temperature lamp bead module. The high color temperature lamp bead module and the low color temperature lamp bead module emit the light of different brightness.

In one embodiment of the present invention, the driving power supply is a constant power supply.

In one embodiment of the present invention, the circuit switch comprises the first switch, the second switch, the third switch and the fourth switch;

One end of the first switch is electrically connected to the driving power supply and the other end is electrically connected to the low color temperature lamp bead module;

One end of the second switch is electrically connected to the driving power supply and the other end is electrically connected to the high color temperature lamp bead module;

The third switch and the fourth switch are disconnected from the high color temperature lamp bead module and the low color temperature lamp bead module;

The combination of the first switch and the second switch is the first level; the combination of the first switch and the third switch is the second level; the combination of the second switch and the fourth switch is the third level.

In one embodiment of the present invention, the double color temperature lamp also comprises resistance R1. One end of the resistance R1 is electrically connected to one end of the high color temperature lamp bead module near to the circuit switch, and the other end is electrically connected to one end of the low color temperature lamp bead module near to the circuit switch.

In one embodiment of the present invention, the circuit switch is two-pole three-position switch;

Or the circuit switch is two-pole four-position switch.

In one embodiment of the present invention, the driving power supply also comprises the power control circuit;

The double color temperature lamp also includes a power switch. The power switch is electrically connected to the power control circuit and adjusts the current value output by the driving power supply through the power control circuit.

In one embodiment of the present invention, the luminous module comprises:

Heat sink, which is set on the base. A plurality of accommodating grooves are arranged on the circumferential side of the heat sink;

A plurality of lamp panels that are electrically connected to the circuit switch. A plurality of the lamp panels are arranged in the accommodating grooves. Any lamp panel includes the high color temperature lamp bead module and the low color temperature lamp bead module; and A plurality of lamp covers that cover the accommodating grooves.

In one embodiment of the present invention, the heat sink has a heat dissipation space and multiple heat dissipation ports. The heat dissipation space is located in the middle of the heat sink, multiple said heat dissipation ports are connected to the heat dissipation space and multiple said heat dissipation ports are arranged around the heat dissipation space. The heat dissipation port is used to connect the heat dissipation space and the external space of the heat sink.

In one embodiment of the present invention, the double color temperature lamp also includes the expansion interface that is electrically connected to the driving power supply. The expansion interface is located in one end of the luminous module away from the base and is electrically connected to the power regulation device.

In one embodiment of the present invention, the expansion interface is headphone interface;

Or the expansion interface is the mobile phone charging interface;

Or the expansion interface is the RJ45 interface;

Or the expansion interface is the USB interface.

In the technical scheme of the present invention, the driving power supply is provided with the circuit switch. The circuit switch has multiple levels. The luminous module includes the high color temperature lamp bead module and the low color temperature lamp bead module. That is to say, the high color temperature lamp bead module includes multiple luminous lamp beads of high color temperature and the low color temperature lamp bead module includes multiple luminous lamp beads of low color temperature; Specifically, the circuit structure corresponding to multiple levels is electrically connected to the high color temperature lamp bead module and the low color temperature lamp bead module. That is to say, the high color temperature lamp bead module and the low color temperature lamp bead module are connected to the driving power supply through multiple levels of the circuit switch, so that they can connect to the corresponding circuit structure of multiple levels through the conductive contact of the circuit switch, and connect to the corresponding circuits of the connected grades. As a result, the high color temperature lamp bead module and the low color temperature lamp bead module can emit light according to the predetermined luminous brightness and the adjustable driving power supply can be avoided on the double color temperature lamp. The power specifications can be reduced when producing the lamps of different color temperatures. The color temperature adjustment can be achieved by matching the driving power supply and the circuit switch, in order to simplify the circuit structure, improve the production efficiency of the lamps and facilitate the batch production of the double color temperature lamps.

BRIEF DESCRIPTION OF THE DRAWINGS

To better describe the technical schemes of the present invention embodiment or prior art, a brief introduction of drawings to be used in the descriptions of the embodiment or prior art is made hereby. Obviously, the drawings described below are only several embodiments of the present invention. For common technicians in this field, they can obtain other drawings based on these structures shown in the drawings without making additional creative endeavors.

Figure 1:
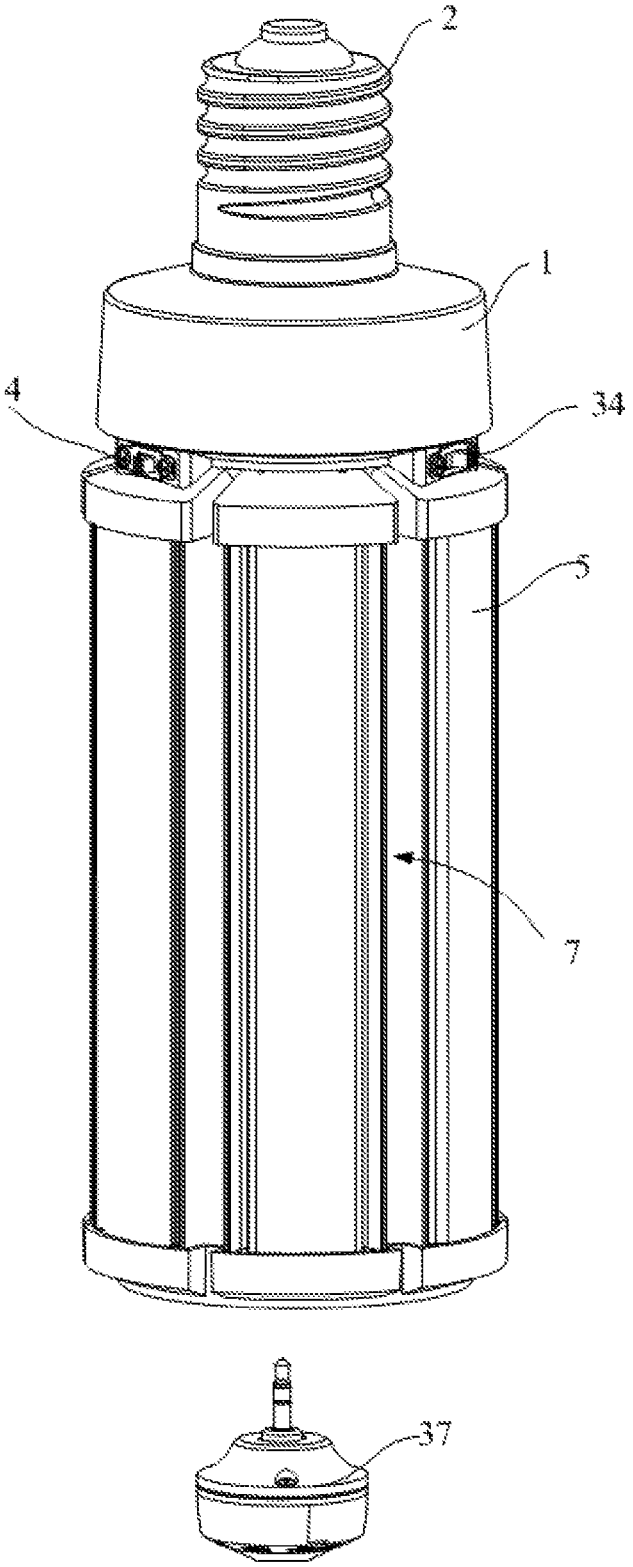
FIG. 1 is the structure diagram of an embodiment of the double color temperature lamp in the present invention.

The implementation, functional characteristics and advantages of the present invention will be further illustrated hereinafter in conjunction with the embodiments and accompanying drawings.

DETAILED DESCRIPTION

A clear and complete description of the technical schemes combined with the drawing in the present invention embodiments, the present invention embodiments clearly and completely describe the technical programs. Obviously, only some embodiments of this invention (instead of all the present invention embodiments) are described here. Based on the embodiment of the present invention, all other embodiments acquired by the common technicians in this field without creative work, shall be in the protection scope of the present invention.

It should be noted that, if there is a directional indication (upper, lower, left, right, front, and rear, etc.) in the embodiment of the present invention, the directional indication is only used to explain the relative positional relationship, motion condition, etc. between the components in a particular position (as shown in the drawing), and if the particular attitude is changed, the directional indication is changed accordingly.

In addition, if there are descriptions relating to "first", "second" and the like in embodiments of the present invention, such descriptions of "first", "second" and the like are for descriptive purposes only and are not to be construed as indicating or implying their relative importance or implying an indication of the number of indicated technical features. As such, a feature that defines as "first", "second" may explicitly or implicitly include at least one of that features. In addition, the "and/or" as stated in the whole text should be understood as there are three paralleled schemes where scheme A, or scheme B or scheme A and scheme B can be met at the same time (taking "A and/or B as an example"). In addition, the technical schemes of embodiments may be combined with each other, but must be available for common technicians in this field, and when the combination of the technical scheme is contradictory or impossible, it should be considered that the combination of the technical scheme does not exist and not fall within the scope of the present invention.

The present invention puts forward a kind of double color temperature lamp, including multiple high color temperature lamp beads and low color temperature lamp beads. By controlling the luminous ratio of high color temperature lamp bead and low color temperature lamp bead, the visual effect of the light can be adjusted comprehensively. Refer to FIG. 1, the structure diagram of one embodiment of the double color temperature lamp in the present invention; refer to FIG. 2, the structure diagram of profile of the double color temperature lamp in FIG. 1; refer to FIG. 3, the schematic diagram of assembly structure of the double color temperature lamp in FIG. 1; refer to FIG. 4, the structure diagram of another perspective of the double color temperature lamp in FIG. 1; refer to FIG. 5, the schematic diagram of circuit structure of the double color temperature lamp in the present invention; refer to FIG. 6, the schematic diagram of circuit structure of the circuit switch in FIG. 5; refer to FIG. 7, the schematic diagram of another form of circuit structure of the double color temperature lamp in the present invention; refer to FIG. 8, the schematic diagram of circuit structure of the circuit switch in FIG. 7.

Figure 2:
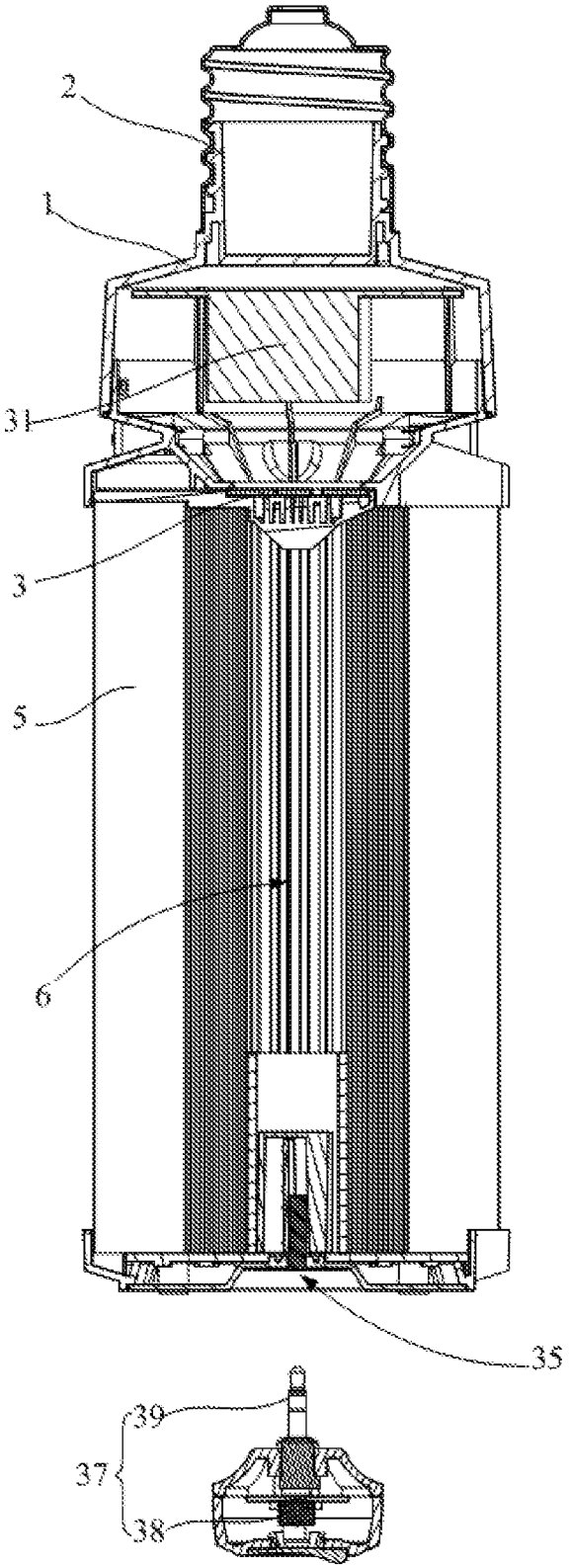
FIG. 2 is the structure diagram of profile of the double color temperature lamp in FIG. 1.
Figure 3:
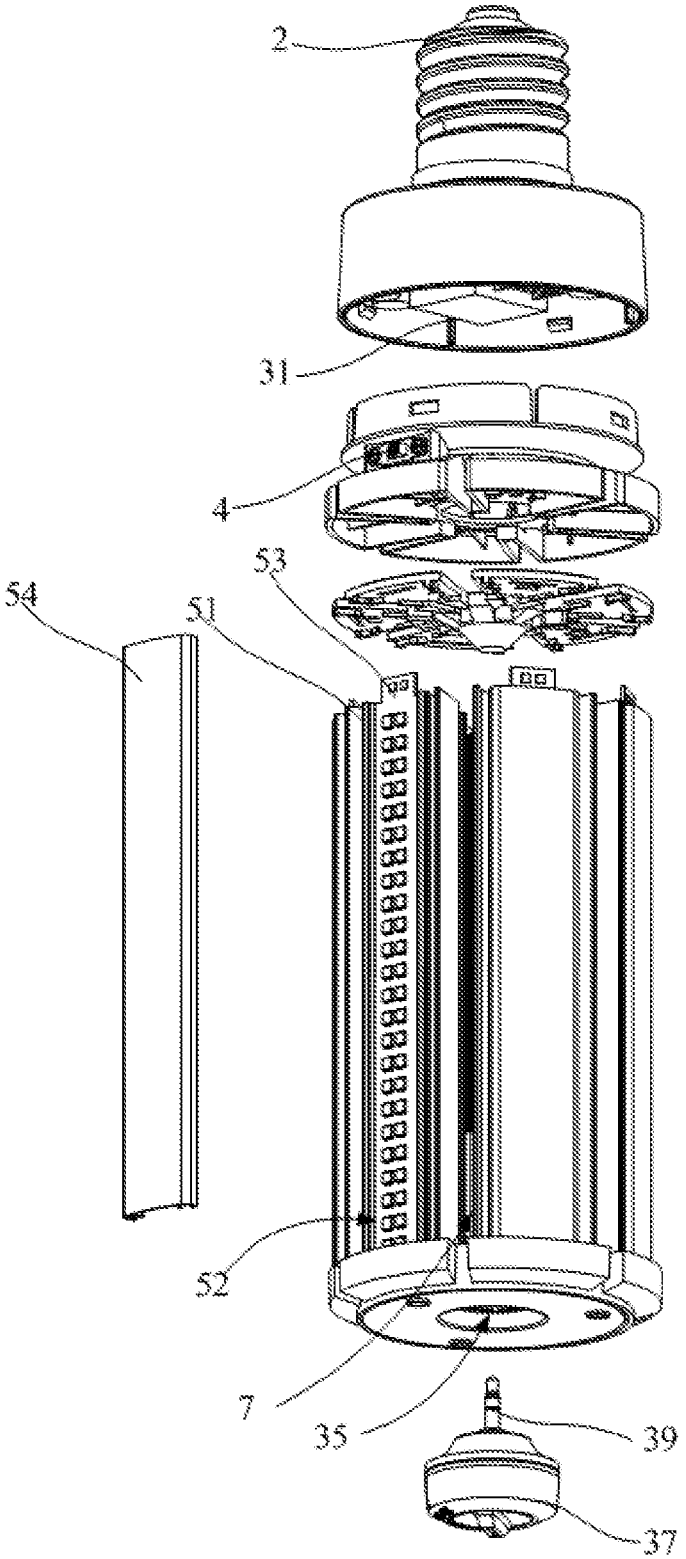
FIG. 3 is the schematic diagram of assembly structure of the double color temperature lamp in FIG. 1.

In the embodiment of the present invention, as shown in FIGS. 1, 2 and 3, the double color temperature lamp includes: base 1 and luminous module 5. The luminous module 5 is connected to the base 1. Understandably, the base 1 is of common model. The base 1 is electrically connected to the lamp base to supply power to the luminous module 5. Optionally, the lamp base is a common lamp base, such as: ordinary screw lamp base and bayonet lamp base.

The base 1 comprises the power access terminal 2 of electrical connection, the driving power supply 31 and the circuit switch 4. The circuit switch 4 has multiple levels. Understandably, the power access terminal 2 may be connected to the metal contact of the driving power supply 31 and the metal contact is used for the electric connection to the lamp base. In addition, the driving power supply 31 is of common specification and model, which is used to convert the power supply to a specific voltage and current to drive the power converter for lamp light.

On the other hand, as shown in FIG. 2, the base 1 includes the control circuit board 3, and the control circuit board 3 connects the driving power supply 31, the luminous module 5 and the circuit switch 4. The driving circuit board 3 is used as the wiring carrier of the driving power supply 31, the luminous module 5 and the circuit switch 4.

Understandably, the driving power supply 31 includes the power output terminal and the power input terminal. The power output terminal is used to output the power converted by the driving power supply 31 to the luminous module 5. That is to say, after the household power supply is imported to the driving power supply 31 by the power access terminal 2, the driving power supply 31 converts the power supply to the working power supply of the luminous module 5 and transmits to the luminous module 5 through the power output terminal and the power input terminal.

Figure 5:
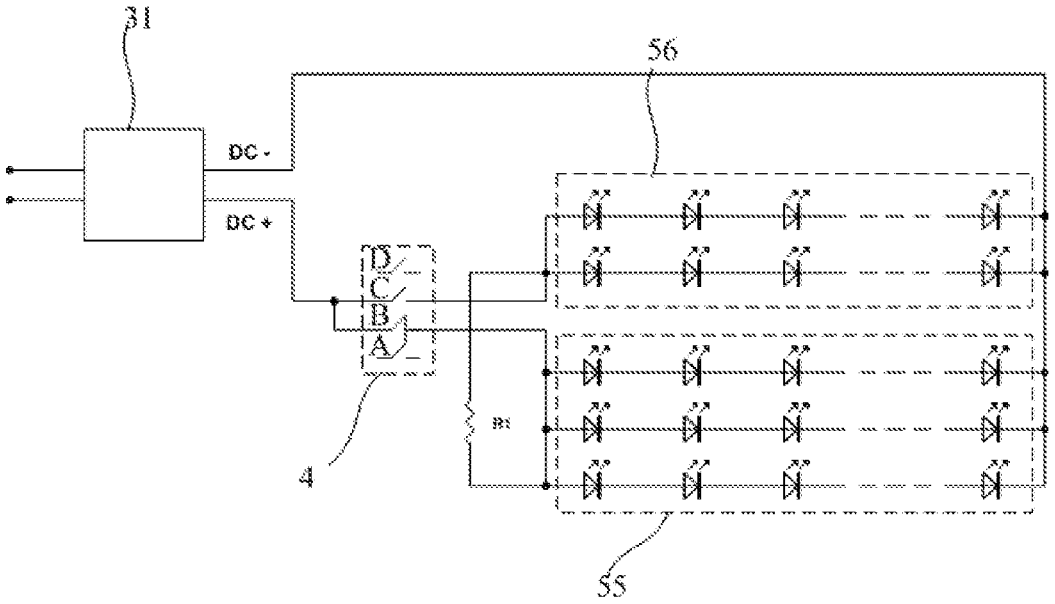
FIG. 5 is the schematic diagram of circuit structure of the double color temperature lamp in the present invention.
Figure 7:
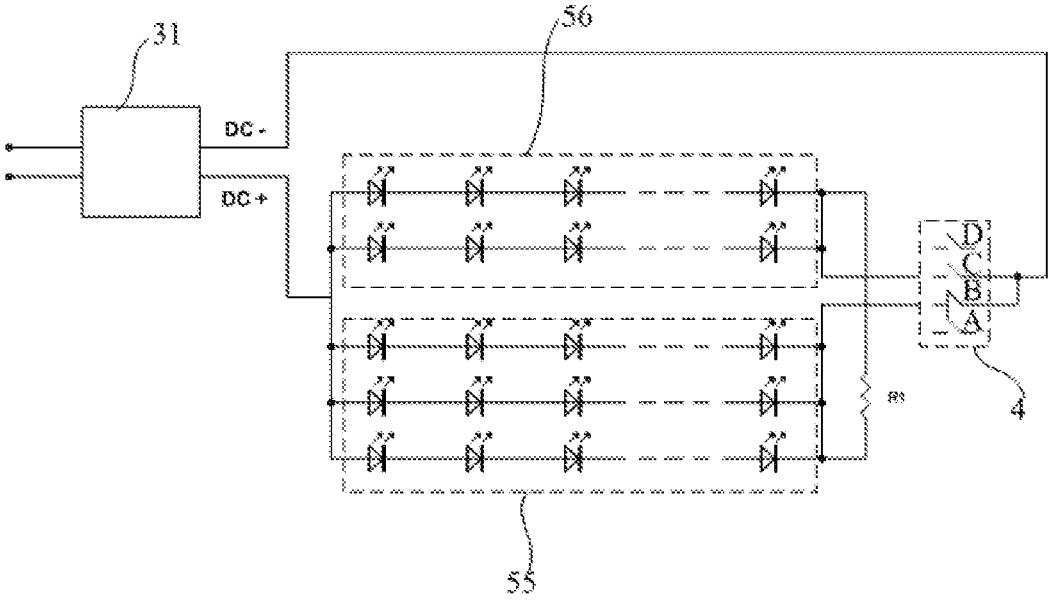
FIG. 7 is the schematic diagram of another form of circuit structure of the double color temperature lamp in the present invention.

Optionally, as shown in FIGS. 5 and 7, the driving power supply 31 is provided with the positive pole of power output and the negative pole of power out. One of the positive poles and negative pole is connected to the circuit switch 4. One end of the luminous module 5 is connected to the circuit switch 4 and the other end of the luminous module 5 is electrically connected to the positive pole/the negative pole.

As shown in FIGS. 5 and 7, the luminous module 5 comprises the high color temperature lamp bead module 55 and the low color temperature lamp bead module 56. The high color temperature lamp bead module 55 and the low color temperature lamp bead module 56 are electrically connected to multiple levels of the circuit switch 4. Understandably, the luminous module 5 may include multiple lamp panels 53. Each lamp panel 53 is provided with the high color temperature lamp bead module 55 and the low color temperature lamp bead module 56. The high color temperature lamp bead module 55 includes multiple high color temperature lamp beads and the low color temperature lamp bead module 56 includes multiple low color temperature lamp beads. Multiple high color temperature lamp beads and low color temperature lamp beads are electrically connected to multiple levels of the circuit switch 4. That is to say, the circuit switch 4 is provided with multiple switches (not shown in the figure). Multiple switches are connected to multiple high color temperature lamp beads and multiple low color temperature lamp beads to form multiple levels, such as: one switch is directly connected to multiple high color temperature lamp beads and the other switch is directly connected to multiple low color temperature lamp beads to form two levels. Of course, another switch can also be connected to multiple high color temperature lamp beads and multiple low color temperature lamp beads. The third level is formed combining with the former two switches; Another switch may be in off state and form the fourth level with the former three switches.

Figure 6:
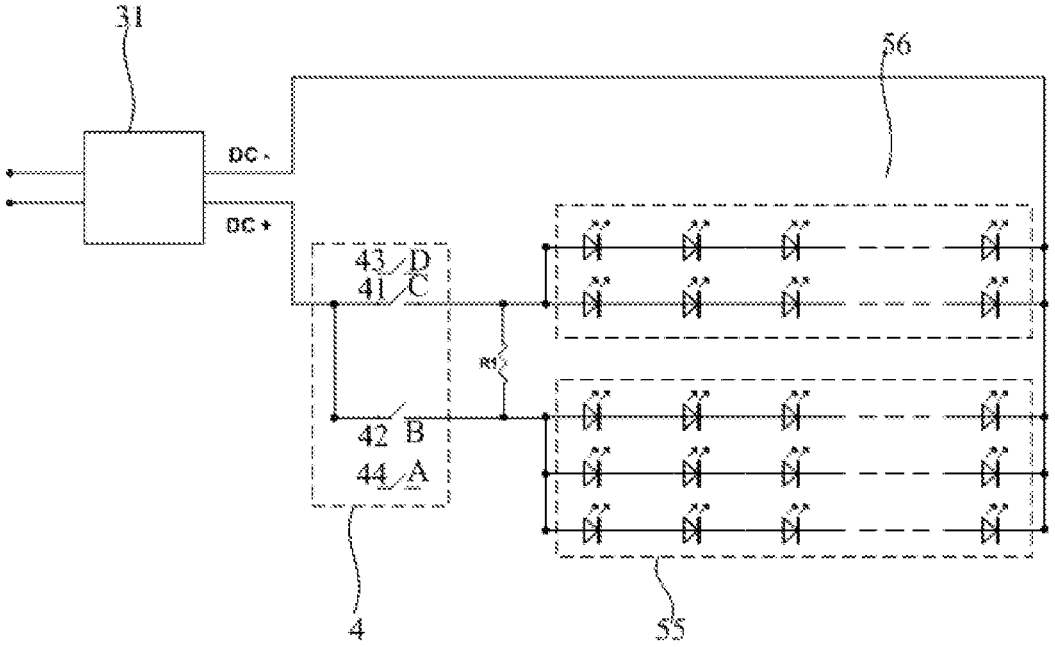
FIG. 6 is the schematic diagram of circuit structure of the circuit switch in FIG. 5.
Figure 8:
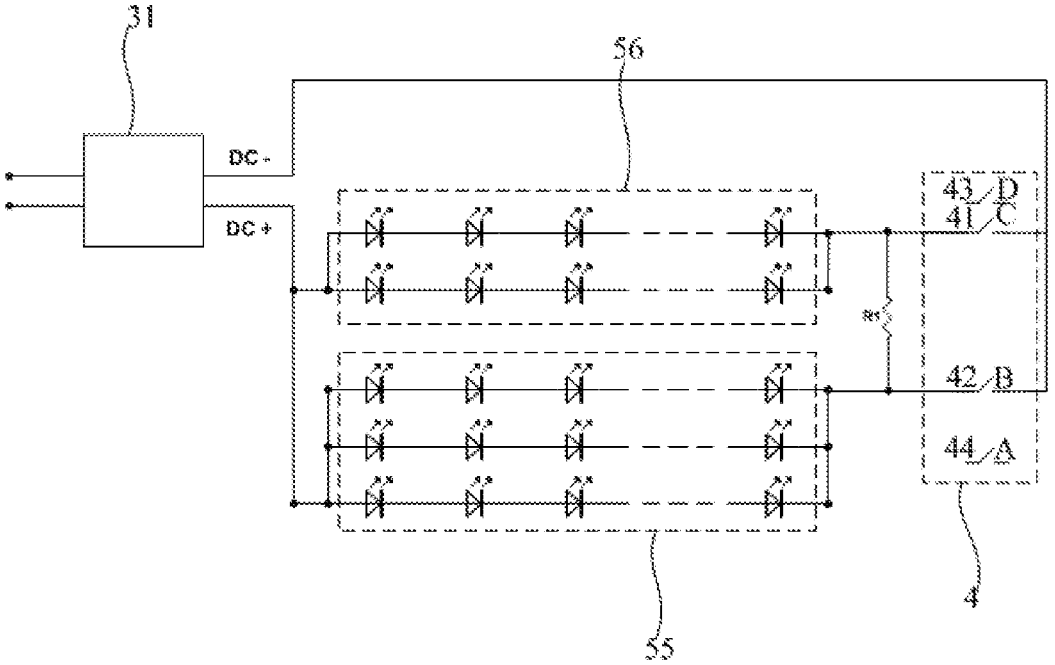
FIG. 8 is the schematic diagram of circuit structure of the circuit switch in FIG. 7.

Optionally, as shown in FIGS. 6 and 8, the circuit switch 4 may be a three-level two-position switch. The three-level two-position switch refers to the contact on the sliding switch. Two switches may be closed at the same time, so that four switches form three levels. For example: the three-level two-position switch respectively includes the first switch 41, the second switch 42, the third switch 43 and the fourth switch 44. The third switch 43, the first switch 41, the second switch 42 and the fourth switch 44 are arranged in a row. The third switch 43 and the fourth switch 44 are not connected to the high color temperature lamp bead module 55 and the low color temperature lamp bead module 56. The second switch 42 and the first switch 41 are connected to the driving power supply 31, and connected to the high color temperature lamp bead module 55 and the low color temperature lamp bead module 56 respectively.

Optionally, the first switch 41 is corresponding to C switch. The second switch 42 is corresponding to B switch. The third switch 43 is corresponding to D switch. The fourth switch 44 is corresponding to A switch.

Understandably, the third switch 43 and the fourth switch 44 are not connected to the high color temperature lamp bead module 55 and the low color temperature lamp bead module 56. It means that: the connecting terminal of the third switch 43 and the fourth switch 44 is not connected to any circuit device. Or, the connecting terminal of the third switch 43 and the fourth switch 44 is not connected to the high color temperature lamp bead module 55 and the low color temperature lamp bead module 56, and the third switch 43 and the fourth switch 44 are electrically connected to other auxiliary circuits.

In this way, when the contacts slide, the contact closes the third switch 43 and the first switch 41; the low color temperature lamp bead module 56 is on and the high color temperature lamp bead module 55 is off, forming the level I. The contact closes the second switch 42 and the first switch 41; the low color temperature lamp bead module 56 and the high color temperature lamp bead module 55 are on, forming the level II. The contact closes the second switch 42 and the fourth switch 44; the low color temperature lamp bead module 56 is off and the high color temperature lamp bead module 55 is on, forming the level III.

In practical application, by adjusting the level of circuit switch 4, the driving power supply 31 is connected to the high color temperature lamp bead module 55 and/or the low color temperature lamp bead module 56, and the high color temperature lamp bead module 55 and the low color temperature lamp bead module 56 emit the light of different brightness.

Understandably, as shown in FIGS. 6 and 8, a resistance R1 may be connected between the low color temperature lamp bead module 56 and the high color temperature lamp bead module 55. When the circuit switch at level I, only low color temperature lamp bead module 56 is on with the highest brightness. Partial current flows from the resistance R1 to the high color temperature lamp bead module 55, making the high color temperature lamp bead module 55 light up in weak light. The brightness of high color temperature lamp bead module 55 is determined by the resistance value of R1. When the circuit switch is at level III, only high color temperature lamp bead module 55 is on with the highest brightness. Partial current flows from the resistance R1 to the low color temperature lamp bead module 56, making the low color temperature lamp bead module 56 light up in weak light. The brightness of low color temperature lamp bead module 56 is determined by the resistance value of R1.

In one embodiment of the present invention, because the resistance R1 is connected between the low color temperature lamp bead module 56 and the high color temperature lamp bead module 55, the quantity of high color temperature lamp beads and low color temperature lamp beads can be reduced. Examples are illustrated as below:

Suppose a kind of lamp with regulating color temperature of 18 W adopts high color temperature lamp bead and low color temperature lamp bead that the specification is LED lamp bead with voltage (VF) 3V and rated current 60 mA. Suppose the efficiency of the driving power supply is 90%. To ensure the rated life of LED lamp bead, suppose the maximum working current of the LED lamp bead is 55 mA and the quantity of high color temperature lamp bead and low color temperature lamp bead is the same.

When the circuit of the lamp does not connect to R1, the lamp may obtain three color temperature states (3000K, 4000K, and 5000K) by mixing 3000K color temperature and 5000K lamp bead. At this time, the working current of the lamp bead is the largest at the highest color temperature and the lowest color temperature of the whole lamp; when the color temperature of the whole lamp is 3000K or 5000K, respectively 98 high color temperature lamp beads and low color temperature lamp beads are needed.

When the circuit of the lamp connects to R1, the lamp may obtain three color temperature states (about 3000K, 4000K, and 5000K) by mixing 2700K color temperature and 5700K lamp bead. At this time, at the highest color temperature and the lowest color temperature of the whole lamp, the working current of the lamp bead is the largest. Because R1 resistance has shunting action, 3000K color temperature can be obtained by mixing 2700K lamp bead of high brightness and 5700K color temperature lamp bead of low brightness. Supposing the working current of 2700K lamp bead is 55 mA because of R1 shunting, the brightness of 5700K lamp bead is 20% of 2700K lamp bead. At this time, the working current of 5700K lamp bead is 14 mA. Respective 80 high color temperature lamp beads and low color temperature lamp beads are needed. Similarly, when the color temperature of the lamp is 5000K and if the brightness of 2700K lamp bead is 20% of 5700K lamp bead, respective 80 high color temperature lamp beads and low color temperature lamp beads are needed.

Thus, it can be seen due to the shunting action of R1, the quantity of lamp beads can be reduced effectively by mixing the lamp beads higher than the whole lamp color temperature and the lamp beads lower than the whole lamp color temperature at the highest color temperature and the lowest color temperature states. The reduction of lamp bead quantity is related to R1 resistance value, LED lamp bead color temperature and the adjustable scope of color temperature required by the whole lamp.

In addition, the shunting action of R1 can make the whole light dissipate heat evenly at the lowest color temperature state and the highest color temperature state to improve the heat dissipation performance of the lamp.

In the present embodiment, the driving power supply 31 is provided with the circuit switch 4. The circuit switch 4 has multiple levels. The luminous module 5 includes the high color temperature lamp bead module 55 and the low color temperature lamp bead module 56. That is to say, the high color temperature lamp bead module 55 includes multiple luminous lamp beads of high color temperature and the low color temperature lamp bead module 56 includes multiple luminous lamp beads of low color temperature; Specifically, the circuit structure corresponding to multiple levels is electrically connected to the high color temperature lamp bead module 55 and the low color temperature lamp bead module 56. That is to say, the high color temperature lamp bead module 55 and the low color temperature lamp bead module 56 are connected to the driving power supply 31 through multiple levels of the circuit switch 4, so that they can connect to the corresponding circuit structure of multiple levels through the conductive contact of the circuit switch 4, and connect to the corresponding circuits of the connected grades. As a result, the high color temperature lamp bead module 55 and the low color temperature lamp bead module 56 can emit light according to the predetermined luminous brightness and the adjustable driving power supply 31 can be avoided on the double color temperature lamp. The power specifications can be reduced when producing the lamps of different color temperatures. The color temperature adjustment can be achieved by matching the driving power supply 31 and the circuit switch 4, in order to simplify the circuit structure, improve the production efficiency of the lamps and facilitate the batch production of the double color temperature lamps.

In one embodiment of the present invention, the driving power supply 31 is constant power supply that outputs constant current or stable voltage.

In one embodiment of the present invention, as shown in FIGS. 6 and 8, the circuit switch 4 may be a two-pole three-position switch. The circuit switch 4 includes the first switch 41, the second switch 42, the third switch 43 and the fourth switch 44; one end of the first switch 41 is electrically connected to the driving power supply 31, and the other end is electrically connected to the low color temperature lamp bead module 56; one end of the second switch 42 is electrically connected to the driving power supply 31, and the other end is electrically connected to the high color temperature lamp bead module 55; the third switch 43 and the fourth switch 44 are disconnected from the high color temperature lamp bead module 55 and the low color temperature lamp bead module 56.

Among them, the third switch 43 and the fourth switch 44 are disconnected from the high color temperature lamp bead module 55 and the low color temperature lamp bead module 56, which means: both ends of the third switch 43 and the fourth switch 44 are not connected to the high color temperature lamp bead module 55 and the low color temperature lamp bead module 56. That is to say, the third switch 43 and the fourth switch 44 can be connected to other auxiliary circuits, but not to the high color temperature lamp bead module 55 and the low color temperature lamp bead module 56.

The combination of the first switch 41 and the second switch 42 is the first level; the combination of the first switch 41 and the third switch 43 is the second level; the combination of the second switch 42 and the fourth switch 44 is the third level.

In the present embodiment, when the contacts slide and moves to the first level, the contact closes the third switch 43 and the first switch 41; the low color temperature lamp bead module 56 is on and the high color temperature lamp bead module 55 is off. When the contact moves to the second level, the contact closes the second switch 42 and the first switch 41, and the low color temperature lamp bead module 56 and the high color temperature lamp bead module 55 are on. When the contact moves to the third level, the contact closes the second switch 42 and the fourth switch 44, and the low color temperature lamp bead module 56 is off and the high color temperature lamp bead module 55 is on.

Based on the above, as shown in FIGS. 6 and 8, the circuit switch 4 is two-pole three-position switch. The double color temperature lamp also comprises resistance R1. One end of the resistance R1 is electrically connected to one end of the high color temperature lamp bead module 55 near to the circuit switch 4, and the other end is electrically connected to one end of the low color temperature lamp bead module 56 near to the circuit switch 4.

Understandably, a resistance R1 may be connected between the low color temperature lamp bead module 56 and the high color temperature lamp bead module 55. When the circuit switch at the first level, only low color temperature lamp bead module 56 is on with the highest brightness. Partial current flows from the resistance R1 to the high color temperature lamp bead module 55, making the high color temperature lamp bead module 55 light up in weak light. The brightness of high color temperature lamp bead module 55 is determined by the resistance value of R1. When the circuit switch is at the third level, only high color temperature lamp bead module 55 is on with the highest brightness. Partial current flows from the resistance R1 to the low color temperature lamp bead module 56, making the low color temperature lamp bead module 56 light up in weak light. The brightness of low color temperature lamp bead module 56 is determined by the resistance value of R1. When the circuit switch is in level III, the resistance R1 is short-circuit, and the high color temperature lamp bead module 55 and the low color temperature lamp bead module 56 are on with the highest brightness.

In one embodiment of the present invention, the circuit switch 4 is two-pole four-position switch. Based on the above, the circuit switch 4 also includes the adjacent fourth switch 44 or the fifth switch set on the third switch 43. The fifth switch is connection-free state. The combination of the fifth switch and the fourth switch 44 or the third switch 43 is level IV. When the contact slides to level IV, there is no connection between the high color temperature lamp bead module 55 and the low color temperature lamp bead module 56, or between the low color temperature lamp bead module 56 and the high color temperature lamp bead module 55. That is to say, when the contact slides to level IV, the high color temperature lamp bead module 55 and the low color temperature lamp bead module 56 are disconnected from the driving power supply 31.

Figure 4:
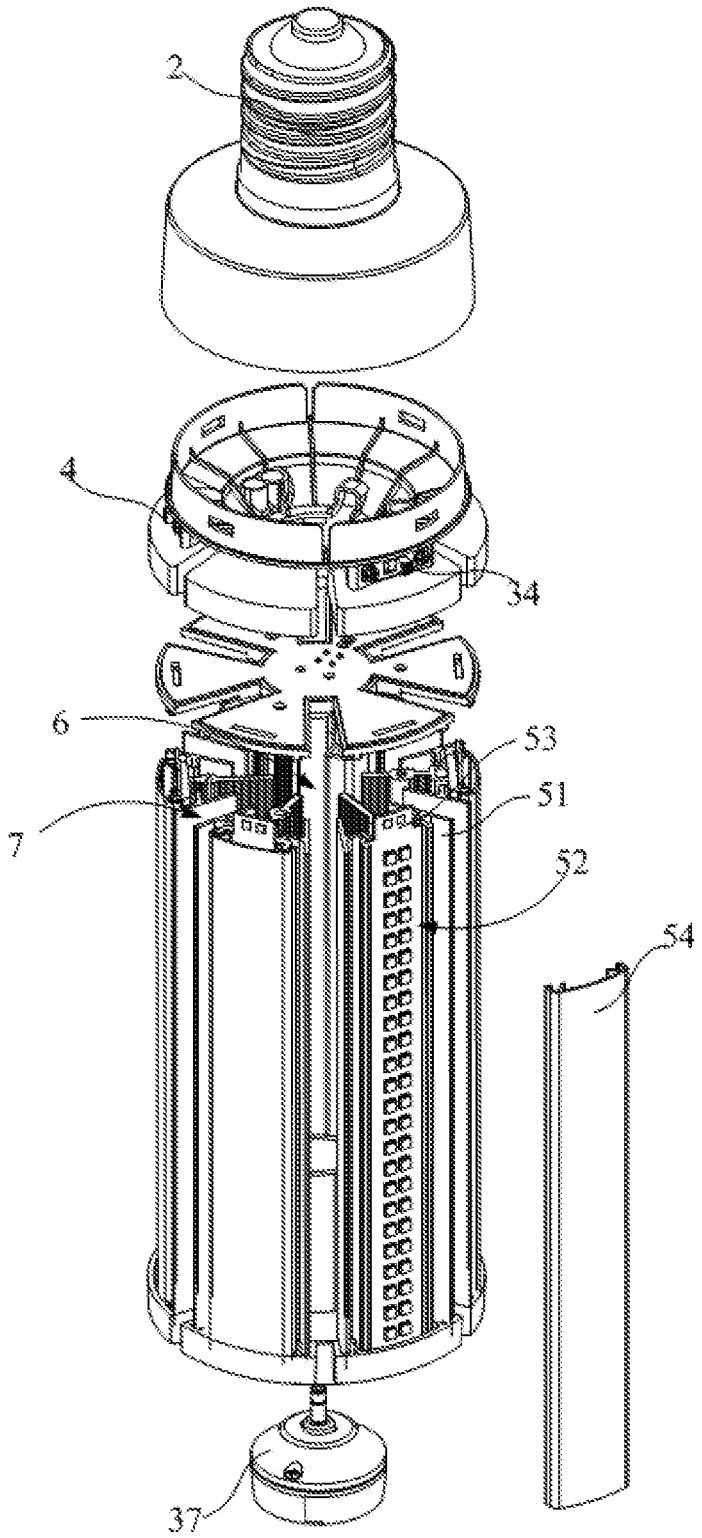
FIG. 4 is the structure diagram of another perspective of the double color temperature lamp in FIG. 1.

In one embodiment of the present invention, as shown in FIGS. 1 and 4, the driving power supply 31 also includes the power control circuit. Understandably, the power adjustment circuit can include conventional power control signal acquisition, power output adjustment circuit and other components.

The double color temperature lamp also includes a power switch 34. The power switch 34 is electrically connected to the power control circuit and adjusts the current value output by the driving power supply 31 through the power control circuit.

In the present embodiment, the power switch 34 is electrically connected to the power regulator. The power switch 34 and the power regulator can regulate the current value output by the driving power supply 31 to control the brightness of the high color temperature lamp bead module 55 and the low color temperature lamp bead module 56.

In one embodiment of the present invention, as shown in FIGS. 3 and 4, the luminous module 5 includes: heat sink 51, multiple lamp panels 53 and multiple lamp covers 54.

The heat sink 51 is located on the base 1 with multiple accommodating grooves 52 around. Understandably, the heat sink 51 is of aluminum alloy material and fixed on the base 1 by screws.

A plurality of lamp panels 53 are electrically connected to the circuit switch 4. A plurality of lamp panels 53 are arranged in the accommodating grooves 52. Any lamp panel 53 includes the high color temperature lamp bead module 55 and the low color temperature lamp bead module 56; multiple lamp covers 54 cover the accommodating groove 52.

In the present embodiment, multiple lamp panels 53 are installed with the heat sink 51 as the carrier to enhance the heat dissipation effect of the lamp. On the other hand, multiple lamp panels 53 are arranged around the heat sink 51 to enhance the light coverage of the luminous module 5 and improve the user's use experience.

Optionally, the lamp cover 54 is of transparent plastic material.

In one embodiment of the present invention, as shown in FIGS. 3 and 4, the heat sink 51 has a heat dissipation space 6 and multiple heat dissipation ports 7. The heat dissipation space 6 is located in the middle of the heat sink 51, multiple heat dissipation ports 7 are connected to the heat dissipation space 6 and multiple heat dissipation ports 7 are arranged around the heat dissipation space 6. The heat dissipation port 7 is used to connect the heat dissipation space 6 and the external space of the heat sink 51. Understandably, a heat dissipation port 7 is arranged between the two adjacent accommodating grooves 52.

Optionally, a plurality of radiating ribs may be provided on the inner wall of the heat sink 51 toward the heat dissipation space 6 (not identified in the figure). A number of radiating ribs are used to increase the air flow rate and speed up the heat dissipation speed.

In one embodiment of the present invention, the double color temperature lamp also includes the expansion interface 35 that is electrically connected to the driving power supply 31. The expansion interface 35 is located in one end of the luminous module 5 away from the base 1 to be electrically connected to the power regulation device 37.

In the present embodiment, an expansion interface 35 is provided on the double color temperature lamp to access the power regulation device 37. Power regulation device 37 is used to input rated electric frequency or current value. Power regulation device 37 is connected to the circuit of driving power supply 31 through expansion interface 35 to adjust the current value outputted by driving power supply 31 by inputting the specific electric frequency value or current value to the circuit of driving power supply 31.

Optionally, circuit structure of lamps is provided with the power regulating chip. When the power regulation module 37 is inserted into expansion interface 35, the power regulating chip is connected. Power regulation device 37 inputs specific frequency or current to power regulating chip, so that the power regulating chip adjusts the output voltage of driving power supply 31.

Understandably, as shown in FIG. 2, the power regulation device 37 includes the knob potentiometer 38 and the connecting plug 39. The knob potentiometer 38 is electrically connected to the connecting plug 39. The knob potentiometer 38 is electrically connected to the circuit where the driving power supply 31 is located by the matching of the connecting plug 39 and the expansion interface 35. The connecting plug 39 is matched with the expansion interface 35.

In one embodiment of the present invention, the expansion interface 35 is headphone interface. Understandably, headphone interfaces can be headphone interfaces of any specification, such as: interface of 2.5 mm or 3.5 mm; of course, the expansion interface 35 can also be a serial bus interface.

In one embodiment of the present invention, the expansion interface 35 is mobile phone charging interface. Understandably, there are three common interfaces of mobile phone charging plug, namely MicroUSB interface, USB-TypeC interface and Lightning interface.

In one embodiment of the present invention, expansion interface 35 is RJ45 interface, namely the common type of communication lead-end connection interface;

In one embodiment of the present invention, the expansion interface 35 is USB interface (serial bus interface).

The description is only the preferred embodiment of the present invention, and it is not for this reason that the patent scope of the present invention is limited. Any equivalent structural transformation made by using the description of the present invention and the drawing, or direct/indirect application in other related innovation fields under the inventive concept of the present invention, is included in the patent protection scope of the present invention.

What is claimed is:

1. A double color temperature lamp comprising:

a base comprising a power access terminal of an electrical connection, a driving power supply and a circuit switch, the circuit switch having multiple levels; and a luminous module comprising a high color temperature lamp bead module and a low color temperature lamp bead module, the high color temperature lamp bead module and the low color temperature lamp bead module are respectively electrically connected to multiple levels of the circuit switch, wherein the circuit switch is switchable to interchangeably connect the driving power supply to the high color temperature lamp bead module only, the low color temperature lamp bead module only, and to both the high color temperature lamp bead module and the low color temperature lamp bead module simultaneously, wherein the high color temperature lamp bead module and the low color temperature lamp bead module emit light of different brightness, wherein the circuit switch comprises a first switch, a second switch, a third switch and a fourth switch:

one end of the first switch is electrically connected to the driving power supply and another end is electrically connected to the low color temperature lamp bead module;

one end of the second switch is electrically connected to the driving power supply and another end is electrically connected to the high color temperature lamp bead module;

the third switch and the fourth switch are disconnected from the high color temperature lamp bead module and the low color temperature lamp bead module;

a combination of the first switch and the second switch is a first level;

a combination of the first switch and the third switch is a second level; and a combination of the second switch and the fourth switch is the third level.

2. The double color temperature lamp as in claim 1, wherein the driving power supply is a constant power supply.

3. The double color temperature lamp as in claim 1, wherein the double color temperature lamp further comprises a resistor, one end of the resistor is electrically connected to one end of the high color temperature lamp bead module near to the circuit switch, and the other end is electrically connected to one end of the low color temperature lamp bead module near to the circuit switch.

4. The double color temperature lamp as in claim 1, wherein the circuit switch is two-pole three-position switch; or the circuit switch is two-pole four-position switch.

5. The double color temperature lamp as in claim 1, wherein the driving power supply also comprises a power control circuit; and the double color temperature lamp also includes a power switch, the power switch is electrically connected to the power control circuit and adjusts a current value output by the driving power supply through the power control circuit.

6. The double color temperature lamp as in claim 1, wherein the luminous module includes:

a heat sink, which is set on a base;

a plurality of accommodating grooves is arranged on a circumferential side of a heat sink;

a plurality of lamp panels that are electrically connected to the circuit switch;

a plurality of the lamp panels is arranged in the accommodating grooves;

one or more lamp panel includes the high color temperature lamp bead module and the low color temperature lamp bead module; and a plurality of lamp covers that cover the accommodating grooves.

7. The double color temperature lamp as in claim 6, wherein the heat sink has a heat dissipation space and multiple heat dissipation ports, the heat dissipation space is located in a middle of the heat sink, multiple said heat dissipation ports are connected to the heat dissipation space and multiple said heat dissipation ports are arranged around the heat dissipation space, the heat dissipation port is used to connect the heat dissipation space and an external space of the heat sink.

8. The double color temperature lamp as in claim 1, wherein the double color temperature lamp also includes an expansion interface that is electrically connected to the driving power supply, the expansion interface is located in one end of the luminous module away from the base and is electrically connected to a power regulation device.

9. The double color temperature lamp as in claim 8, wherein the expansion interface is a headphone interface;

the expansion interface is a mobile phone charging interface;

the expansion interface is a RJ45 interface; or the expansion interface is a USB interface.

10. A double color temperature lamp comprising:

a base comprising a power access terminal of an electrical connection, a driving power supply and a circuit switch, the circuit switch having multiple levels; and a luminous module comprising a high color temperature lamp bead module and a low color temperature lamp bead module, the high color temperature lamp bead module and the low color temperature lamp bead module are respectively electrically connected to multiple levels of the circuit switch, wherein the high color temperature lamp bead module and the low color temperature lamp bead module emit light of different brightness, wherein the high color temperature lamp bead module and the low color temperature lamp bead module are electrically connected to each other near the circuit switch through a resistor so that:

in a first switching state of the circuit switch, a full current flows through the high color temperature lamp bead module and only a partial current, due to the resistor, flows through the low color temperature lamp bead module;

in a second switching state of the circuit switch, the full current flows through the low color temperature lamp bead module and only the partial current, due to the resistor, flows through the high color temperature lamp bead module; and in a third switching state of the circuit switch, the resistor is short circuited and the full current flows through both the low color temperature lamp bead module and the high color temperature lamp bead module.

11. The double color temperature lamp as in claim 10, wherein the driving power supply is a constant power supply.

12. The double color temperature lamp as in claim 10, wherein the circuit switch comprises a first switch, a second switch, a third switch and a fourth switch;

one end of the first switch is electrically connected to the driving power supply and another end is electrically connected to the low color temperature lamp bead module;

one end of the second switch is electrically connected to the driving power supply and another end is electrically connected to the high color temperature lamp bead module;

the third switch and the fourth switch are disconnected from the high color temperature lamp bead module and the low color temperature lamp bead module;

a combination of the first switch and the second switch is a first level;

a combination of the first switch and the third switch is a second level; and a combination of the second switch and the fourth switch is the third level.

13. The double color temperature lamp as in claim 12, wherein the circuit switch is two-pole three-position switch;

or the circuit switch is two-pole four-position switch.

14. The double color temperature lamp as in claim 10, wherein the driving power supply also comprises a power control circuit; and the double color temperature lamp also includes a power switch, the power switch is electrically connected to the power control circuit and adjusts a current value output by the driving power supply through the power control circuit.

15. The double color temperature lamp as in claim 10, wherein the luminous module includes:

a heat sink, which is set on a base;

a plurality of accommodating grooves is arranged on a circumferential side of a heat sink;

a plurality of lamp panels that are electrically connected to the circuit switch;

a plurality of the lamp panels is arranged in the accommodating grooves;

one or more lamp panel includes the high color temperature lamp bead module and the low color temperature lamp bead module; and a plurality of lamp covers that cover the accommodating grooves.

16. The double color temperature lamp as in claim 15, wherein the heat sink has a heat dissipation space and multiple heat dissipation ports, the heat dissipation space is located in a middle of the heat sink, multiple said heat dissipation ports are connected to the heat dissipation space and multiple said heat dissipation ports are arranged around the heat dissipation space, the heat dissipation port is used to connect the heat dissipation space and an external space of the heat sink.

17. The double color temperature lamp as in claim 10, wherein the double color temperature lamp also includes an expansion interface that is electrically connected to the driving power supply, the expansion interface is located in one end of the luminous module away from the base and is electrically connected to a power regulation device.

18. The double color temperature lamp as in claim 17, wherein the expansion interface is a headphone interface;

the expansion interface is a mobile phone charging interface;

the expansion interface is a RJ45 interface; or the expansion interface is a USB interface.

* * * * *